US011145453B2

(12) United States Patent
Oishi et al.

(10) Patent No.: US 11,145,453 B2
(45) Date of Patent: Oct. 12, 2021

(54) COIL COMPONENT

(71) Applicant: Murata Manufacturing Co., Ltd., Kyoto-fu (JP)

(72) Inventors: Masayuki Oishi, Nagaokakyo (JP); Yasuhiro Itani, Nagaokakyo (JP); Hiroki Hashimoto, Nagaokakyo (JP); Takuma Shiro, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 472 days.

(21) Appl. No.: 16/175,585

(22) Filed: Oct. 30, 2018

(65) Prior Publication Data

US 2019/0172627 A1 Jun. 6, 2019

(30) Foreign Application Priority Data

Dec. 5, 2017 (JP) ..... JP2017-233367

(51) Int. Cl.

| | |
|---|---|
| ***H01F 27/29*** | (2006.01) |
| ***H01F 27/28*** | (2006.01) |
| ***H01F 17/00*** | (2006.01) |
| *H01F 41/04* | (2006.01) |

(52) U.S. Cl.

CPC ..... *H01F 27/2804* (2013.01); *H01F 17/0013* (2013.01); *H01F 27/292* (2013.01); *H01F 41/043* (2013.01); *H01F 2027/2809* (2013.01)

(58) Field of Classification Search

CPC ..... H01F 27/2804; H01F 17/0013; H01F 41/043; H01F 27/292; H01F 2027/2809; H01F 27/00–40

See application file for complete search history.

(56) References Cited

U.S. PATENT DOCUMENTS

| | | | | |
|---|---|---|---|---|
| 7,663,464 | B2 * | 2/2010 | Yamamoto | H01F 17/0013 336/205 |
| 8,004,383 | B2 * | 8/2011 | Konoue | H01F 17/04 336/200 |
| 9,183,979 | B2 * | 11/2015 | Cha | H01F 41/041 |
| 2010/0006977 | A1 | 1/2010 | Mukaiyama et al. | |

FOREIGN PATENT DOCUMENTS

| | | | |
|---|---|---|---|
| CN | 101625920 | A | 1/2010 |
| JP | H11-219821 | A | 8/1999 |

* cited by examiner

*Primary Examiner* — Tuyen T Nguyen

(74) *Attorney, Agent, or Firm* — Studebaker & Brackett PC

(57) ABSTRACT

A coil component includes an element and a coil that is provided inside the element and that is spirally wound. The coil includes a plurality of coil conductor layers and an extended conductor layer, which are laminated in a first direction. The extended conductor layer overlaps a side gap portion, which is situated on an outer side of a region of the element that is surrounded by the coil conductor layers, and extends so as to reach an outer surface of the element. The element includes a first stress relaxation layer that contacts the coil conductor layers, and a second stress relaxation layer that, while extending along the extended conductor layer, contacts a coil-conductor-layer side of the extended conductor layer, and is positioned inside the side gap portion without reaching the outer surface of the element.

20 Claims, 8 Drawing Sheets

COIL COMPONENT

CROSS-REFERENCE TO RELATED APPLICATION

This application claims benefit of priority to Japanese Patent Application No. 2017-233367, filed Dec. 5, 2017, the entire content of which is incorporated herein by reference.

BACKGROUND

Technical Field

The present disclosure relates to a coil component.

Background Art

As coil components, a coil component described in Japanese Unexamined Patent Application Publication No. 11-219821 exists. This coil component includes a multilayer body including a plurality of magnetic body portions and conductor layers. Gap portions are provided between the magnetic body layers and the conductor layers.

In the above-described existing coil component, since the gap portions surround the conductor layers, the gap portions also surround portions of the conductor layers that are connected to outer electrodes (that is, surround extended conductor portions). In addition, the gap portions that cover the extended conductor portions reach an outer surface of the multilayer body. Therefore, a plating solution or moisture may move along the gap portions and enter the multilayer body, and electrochemical migration of the conductor layers occurs. As a result, reliability of the quality may be reduced due to deterioration in the insulating properties between the conductor layers.

On the other hand, not providing gap portions around the extended conductor portions may be considered. However, in this case, the extended conductor portions directly contact the magnetic body layers, as a result of which stress of the magnetic body layers cannot be reduced. Therefore, a new problem arises in that the stress of the magnetic body layers propagates to the gap portions and cracks are produced in the magnetic body layers from the gap portions.

SUMMARY

Accordingly, the present disclosure provides a coil component that is capable of reducing the occurrence of cracks in an element while ensuring reliability of the quality.

According to preferred embodiments of the present disclosure, a coil component includes an element and a coil that is provided inside the element and that is spirally wound. The coil includes a plurality of coil conductor layers and an extended conductor layer, which are laminated in a first direction. The extended conductor layer overlaps a side gap portion, which is situated on an outer side of a region of the element that is surrounded by the coil conductor layers, and extends so as to reach an outer surface of the element. The element includes a first stress relaxation layer that contacts the coil conductor layers and a second stress relaxation layer that, while extending along the extended conductor layer, contacts a coil-conductor-layer side of the extended conductor layer, and is positioned inside the side gap portion without reaching the outer surface of the element.

According to the preferred embodiments of the present disclosure, in the coil component, since the second stress relaxation layer contacts the coil-conductor-layer side of the extended conductor layer, it is possible to secure a region where the extended conductor layer does not directly contact the element and to reduce the stress of the element between the extended conductor layer and the coil conductors. This makes it possible to reduce propagation of the stress of the element to the first stress relaxation layer, and to reduce cracks that are produced in the element from the first stress relaxation layer.

The second stress relaxation layer is positioned inside the side gap portion, and does not reach the outer surface of the element. Therefore, it is possible to reduce propagation of a plating solution or moisture along the second stress relaxation layer and entry thereof into the element, and to prevent electrochemical migration of the coil conductor layers. As a result, it is possible to ensure insulation properties between the coil conductor layers and to ensure reliability of the quality.

In addition, since the first stress relaxation layer contacts the coil conductor layers, it is possible to reduce application of stress to the element when the coil conductor layers contact the element, and to reduce deterioration in impedance and inductance characteristics.

According to a preferred embodiment of the present disclosure, in the coil component, the plurality of coil conductor layers includes a first coil conductor layer that contacts the extended conductor layer, and the second stress relaxation layer contacts the first coil conductor layer.

According to the preferred embodiment of the present disclosure, the second stress relaxation layer contacts the first coil conductor. Therefore, it is possible to reduce both the stress of the extended conductor layer and the stress of the first coil conductor layer.

According to a preferred embodiment of the present disclosure, in the coil component, a thickness of a portion of the second stress relaxation layer that contacts the first coil conductor layer is greater than or equal to about 1/10 of a thickness of the first coil conductor layer, and is less than or equal to the thickness of the first coil conductor layer. Here, the thickness refers to the size in the first direction.

According to the preferred embodiment, it is possible to ensure the volume of the element and maintain its characteristics while reliably reducing the stress of the element. When the second stress relaxation layer is too thin, the stress of the element cannot be reduced. When the second stress relaxation layer is too thick, the volume of the element is reduced and its characteristics are deteriorated.

According to a preferred embodiment of the present disclosure, in the coil component, a width of the second stress relaxation layer is be greater than or equal to about ½ and less than or equal to about 3/2 (i.e., from about ½ to about 3/2) of a width of the extended conductor layer. Here, the width refers to the size in a direction orthogonal to a direction of extension of the second stress relaxation layer as viewed from the first direction.

According to the preferred embodiment of the present disclosure, it is possible to ensure the volume of the element and maintain its characteristics while reliably reducing the stress of the element. When the width of the second stress relaxation layer is too small, the stress of the element cannot be reduced. When the width of the second stress relaxation layer is too large, the volume of the element is reduced and its characteristics are deteriorated.

According to a preferred embodiment of the present disclosure, in the coil component, the plurality of coil conductor layers includes a second coil conductor layer that contacts the first coil conductor layer; a first end of the second stress relaxation layer in a length direction thereof contacts a first side end of the first coil conductor layer; in the length direction of the second stress relaxation layer, a second end of the second stress relaxation layer in the length direction thereof is situated at a position that is further from the first end than a side end of the first stress relaxation layer that contacts the second coil conductor layer, and is situated at a position that is closer to the first end than a position at about ⅔ of a length of the extended conductor layer from a first contact portion of the first coil conductor layer to the outer surface of the element with reference to the first contact portion of the first side end of the first coil conductor layer that contacts the extended conductor layer. Here, the length direction refers to the direction of extension of the second stress relaxation layer, and the length refers to the size along the direction of extension of the second stress relaxation layer.

According to the preferred embodiment of the present disclosure, since the second end of the second stress relaxation layer in the length direction thereof is situated at a position that is further than the side end of the first stress relaxation layer that contacts the second coil conductor layer, the second stress relaxation layer makes it possible to reduce propagation of the stress of the element to the first stress relaxation layer and reduce cracks that are produced in the element from the first stress relaxation layer.

The second end of the second stress relaxation layer in the length direction thereof is situated at a position that is closer than a position at about ⅔ of the length of the extended conductor layer from the first contact portion of the first coil conductor layer to the outer surface of the element with reference to the first contact portion of the first coil conductor layer. Therefore, it is possible to reduce propagation of a plating solution or moisture along the second stress relaxation layer and entry thereof into the element, and to prevent electrochemical migration of the coil conductor layers. As a result, it is possible to ensure insulation properties between the coil conductor layers and to ensure reliability of the quality.

According to a preferred embodiment of the present disclosure, in the coil component, the plurality of coil conductor layers includes spiral layers that are each wound in a plane, and a thickness of a portion of the element between the spiral layers that are adjacent to each other in the first direction is less than or equal to about 40 μm.

According to the preferred embodiment of the present disclosure, although the interval between adjacent spiral layers in the first direction is small and stress tends to be applied to the element, the second stress relaxation layer makes it possible to reduce cracks that are produced in the element. According to a preferred embodiment of the present disclosure, in the coil component, a thickness of the coil conductor layers is greater than or equal to about 50 μm.

According to the preferred embodiment of the present disclosure, although the coil conductor layers are thick and stress tends to be applied to the element, the second stress relaxation layer makes it possible to reduce cracks that are produced in the element. According to a preferred embodiment of the present disclosure, in the coil component, the first stress relaxation layer and the second stress relaxation layer are each a gap.

According to a preferred embodiment of the present disclosure, in the coil component, the first stress relaxation layer and the second stress relaxation layer is made of oxide powder having a melting point that is higher than a melting point of a magnetic material of which the element is made.

According to a preferred embodiment of the present disclosure, in the coil component, the plurality of coil conductor layers includes a spiral layer that is wound in a plane and a connection layer that connects the spiral layer and the extended conductor layer to each other. The extended conductor layer includes a first end that is exposed from the element, and a second end on a side opposite to the first end. The connection layer overlaps the extended conductor layer on an inner side in a length direction of the extended conductor layer with respect to the second end of the extended conductor layer.

According to the preferred embodiment, it is possible to ensure connectivity between the connection layer and the extended conductor layer regardless of the shape of a side end of the extended conductor layer.

According to a preferred embodiment of the present disclosure, in the coil component, in the length direction of the extended conductor layer, a distance from the second end of the extended conductor layer to a contact portion of a side end of the connection layer that contacts the extended conductor layer is greater than a thickness of the extended conductor layer and is less than twice the thickness of the extended conductor layer.

According to the preferred embodiment of the present disclosure, it is possible to ensure connectivity between the connection layer and the extended conductor layer regardless of the shape of the side end of the extended conductor layer.

According to a preferred embodiment of the present disclosure, in the coil component, the plurality of coil conductor layers includes spiral layers that are each wound in a plane and a connection layer that connects the spiral layers that are adjacent to each other in the first direction. Also, the connection layer overlaps the spiral layers on an inner side in a direction of extension of the spiral layers with respect to a side end of at least one of the spiral layers in a direction of extension of the at least one of the spiral layers.

According to the preferred embodiment, it is possible to ensure connectivity between the connection layer and the spiral layers regardless of the shape of a side end of each spiral layer.

According to a preferred embodiment of the present disclosure, in the coil component, in the direction of extension of the spiral layer, a distance from the side end of the spiral layer to a contact portion of a side end of the connection layer that contacts the spiral layer is greater than a thickness of the spiral layer and is less than twice the thickness of the spiral layer.

According to the preferred embodiment, it is possible to ensure connectivity between the connection layer and the spiral layers regardless of the shape of the side end of each spiral layer.

According to a preferred embodiment of the present disclosure, in the coil component, a sectional shape of each coil conductor layer is substantially hexagonal, and the first stress relaxation layer is formed along only three sides of each coil conductor layer. Also, a thickness of each coil conductor layer on a side where the first stress relaxation layer is formed is greater than a thickness of each coil conductor layer on a side where the first stress relaxation layer is not formed.

According to the preferred embodiment, it is possible to increase the efficiency with which the characteristics resulting from stress release are acquired while ensuring the volume of the coil conductor layers.

The coil component according to the preferred embodiments of the present disclosure is capable of reducing cracks in the element while ensuring reliability of the quality.

Other features, elements, characteristics and advantages of the present disclosure will become more apparent from the following detailed description of preferred embodiments of the present disclosure with reference to the attached drawings.

DETAILED DESCRIPTION

The present disclosure is described in detail below by way of illustrated embodiments.

First Embodiment

Figure 1:
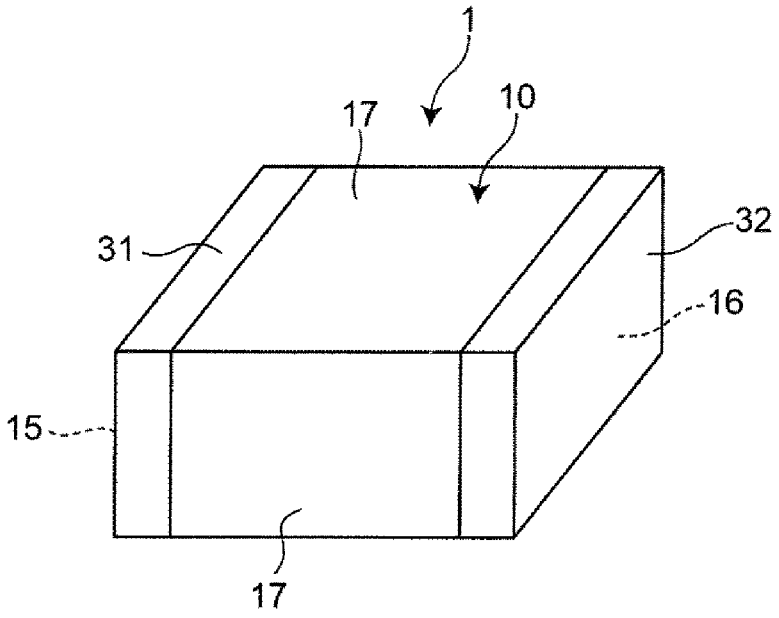
FIG. 1 is a perspective view of a coil component according to a first embodiment of the present disclosure.
Figure 2:
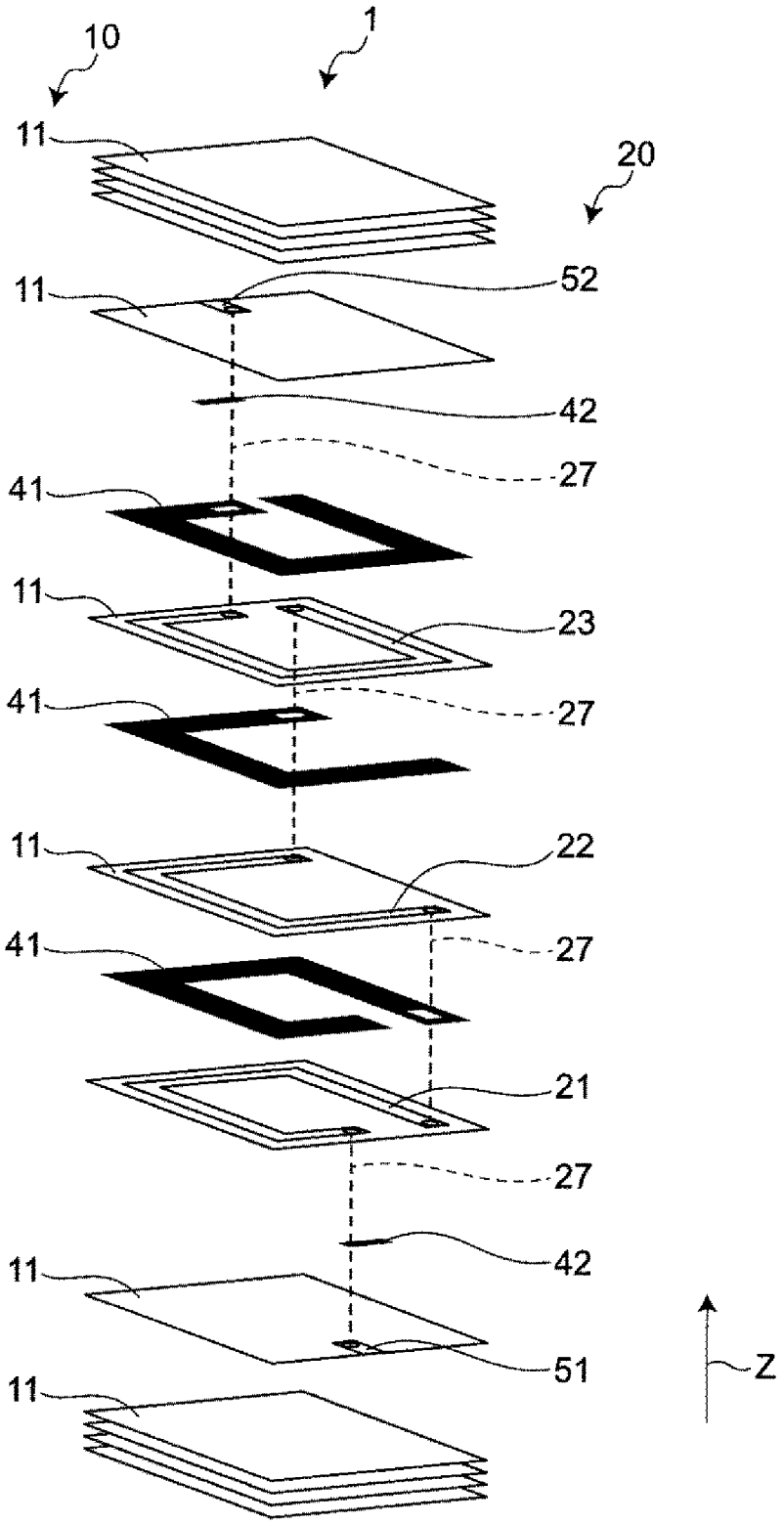
FIG. 2 is an exploded perspective view of the coil component.
Figure 3:
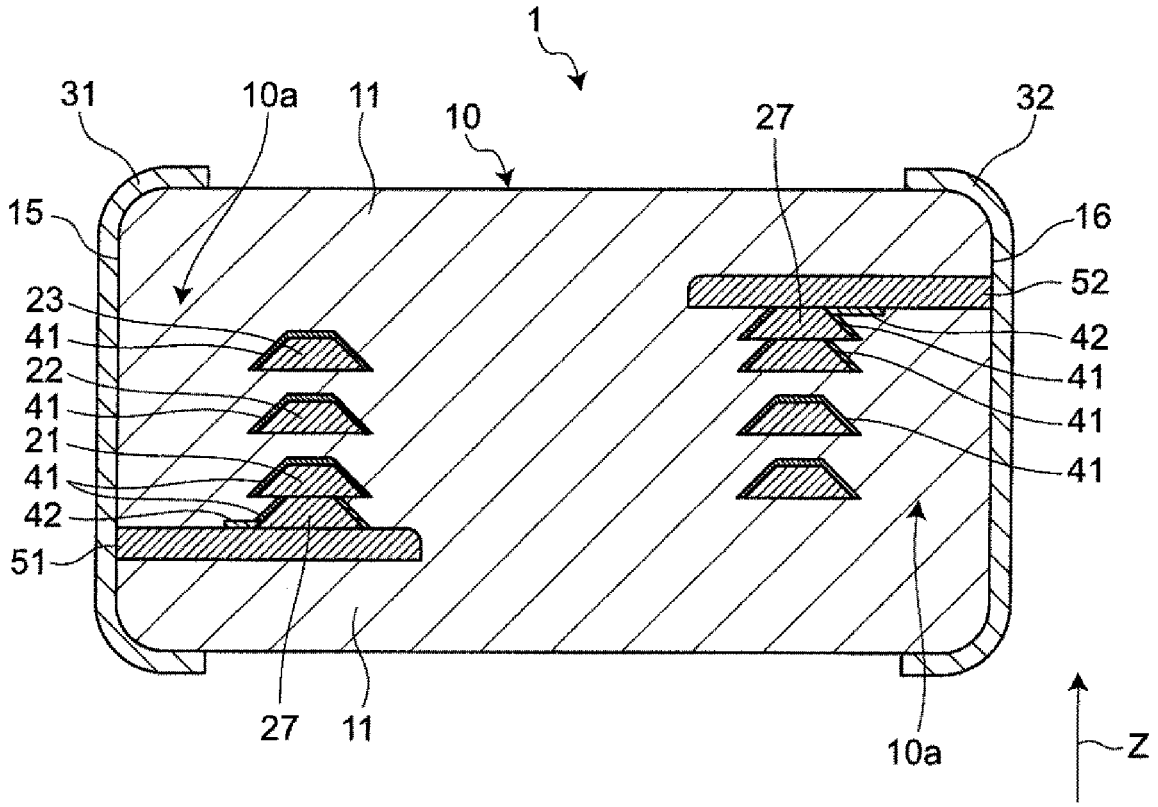
FIG. 3 is a sectional view of the coil component.

FIG. 1 is a perspective view of a coil component 1 according to a first embodiment of the present disclosure. FIG. 2 is an exploded perspective view of the coil component. FIG. 3 is a sectional view of the coil component. As shown in FIGS. 1, 2, and 3, the coil component 1 includes an element 10, a coil 20 that is provided inside the element 10, and a first external electrode 31 and a second external electrode 32 that are provided on surfaces of the element 10 and that are electrically connected to the coil 20.

The coil component 1 is electrically connected to a wire of a circuit board (not shown) via the first external electrode 31 and the second external electrode 32. The coil component 1 is used as, for example, a noise removing filter; and is used in electronic devices, such as a personal computer, a DVD player, a digital camera, TV, a cellular phone, and automotive electronics.

The element 10 includes a plurality of magnetic layers 11, which are laminated to each other in a first direction Z. The magnetic layers 11 are made of, for example, a magnetic material, such as an Ni—Cu—Zn based material. The thickness of each magnetic layer 11 is, for example, greater than or equal to about 5 μm and less than or equal to about 40 μm (i.e., from about 5 μm to about 40 μm). It is to be noted that the element 10 may partly include a non-magnetic layer.

The element 10 has a substantially parallelepiped shape. The surfaces of the element 10 include a first end surface 15, a second end surface 16 that is positioned on a side opposite to the first end surface 15, and four side surfaces 17 that are positioned between the first end surface 15 and the second end surface 16. The first end surface 15 and the second end surface 16 face each other in a direction orthogonal to the first direction Z.

The first external electrode 31 covers the entire first end surface 15 of the element 10 and first-end-surface-15-side end portions of the side surfaces 17 of the element 10. The second external electrode 32 covers the entire second end surface 16 of the element 10 and second-end-surface-16-side end portions of the side surfaces 17 of the element 10.

The coil 20 is spirally wound along the first direction Z. A first end of the coil 20 is exposed from the first end surface 15 of the element 10 and is electrically connected to the first external electrode 31. A second end of the coil 20 is exposed from the second end surface 16 of the element 10 and is electrically connected to the second external electrode 32. The coil 20 is made of, for example, a conductive material, such as Ag or Cu.

The coil 20 includes a plurality of coil conductor layers 21 to 23 and 27, and a first extended conductor layer 51 and a second extended conductor layer 52, which are laminated in the first direction Z. The plurality of coil conductor layers 21 to 23 include corresponding spiral layers 21 to 23, and the coil conductor layers 27 include corresponding connection layers 27.

The plurality of spiral layers 21 to 23 are each wound in a plane. The plurality of spiral layers 21 to 23 are provided on the corresponding magnetic layers 11 and are laminated in the first direction Z. That is, the first spiral layer 21, the second spiral layer 22, and the third spiral layer 23 are successively laminated along the first direction Z. Each of the spiral layers 21 to 23 is formed from one layer, and is formed by, for example, one coating.

The first extended conductor layer 51 and the second extended conductor layer 52 form two respective ends of the coil 20 in the first direction Z. The first extended conductor layer 51 is exposed from the first end surface 15 of the element 10 and is connected to the first external electrode 31. The second extended conductor layer 52 is exposed from the second end surface 16 of the element 10 and is connected to the second external electrode 32.

The first extended conductor layer 51 and the first spiral layer 21 are connected to each other via the connection layer 27 (may also be hereunder called "first connection layer"). The first spiral layer 21 and the second spiral layer 22 that are adjacent to each other in the first direction Z are connected to each other via the connection layer 27 (may also be hereunder called "second connection layer"). The second spiral layer 22 and the third spiral layer 23 that are adjacent to each other in the first direction Z are connected to each other via the connection layer 27 (may also be hereunder called "second connection layer"). The second extended conductor layer 52 and the third spiral layer 23 are connected to each other via the connection layer 27 (may also be hereunder called "second connection layer"). The connection layers 27 extend through the magnetic layers 11 in the first direction Z and extend in the first direction Z. Each connection layer 27 is formed from one layer and is formed by, for example, one coating.

As a method of manufacturing the coil component 1, any one of a sheet lamination method, a hybrid lamination method using a sheet and a magnetic paste, and a printing lamination method using only a paste may be used.

As shown in FIG. 3, as viewed from the first direction Z, the first extended conductor layer 51 and the second extended conductor layer 52 overlap a side gap portion 10*a*, which is situated on an outer side of a region of the element 10 that is surrounded by the coil conductor layers (the spiral layers 21 to 23 and the connection layers 27). The side gap portion 10*a* is a region between side portions of the coil conductor layers and outer surfaces of the element 10. The first extended conductor layer 51 and the second extended conductor layer 52 extend so as to reach the outer surfaces (the first end surface 15 and the second end surface 16, respectively) of the element 10.

The element 10 includes first stress relaxation layers 41 and second stress relaxation layers 42. The first stress relaxation layers 41 contact the corresponding coil conductor layers, and are formed between the coil conductor layers and the magnetic layers corresponding thereto. Each second stress relaxation layer 42, while extending along the extended conductor layer 51 or 52, contacts a coil-conductor-layer side of the extended conductor layer 51 or 52, and is positioned inside the side gap portion 10*a* without reaching the outer surface of the element 10.

Specifically, the first stress relaxation layers 41 are provided on two side surfaces of the first to third spiral layers 21 to 23 corresponding thereto or two side surfaces of the connection layers 27 corresponding thereto. The first stress relaxation layers 41 are provided on regions of upper surfaces of the first to third spiral layers 21 to 23 corresponding thereto excluding the regions that contact the corresponding connection layers 27. One of the second stress relaxation layers 42 is provided on a first-spiral-layer-21 side of the first extended conductor layer 51, and does not reach the first end surface 15 of the element 10. The other second stress relaxation layer 42 is provided on a third-spiral-layer-23 side of the second extended conductor layer 52, and does not reach the second end surface 16 of the element 10.

Stress does not propagate through the first stress relaxation layers 41 and the second stress relaxation layers 42 even if stress is applied thereto. For example, the first stress relaxation layers 41 and the second stress relaxation layers 42 are each a gap. The gaps are formed by, for example, burning up a resin material applied to the magnetic layers 11 by firing. Alternatively, the gaps may be formed by controlling the shrinkage behavior of the material of the stress relaxation layers and the magnetic layers, or by reducing adhesion between the magnetic layers and the stress relaxation layers (pressure is not applied).

Alternatively, the first stress relaxation layers 41 and the second stress relaxation layers 42 are made of, for example, oxide powder having a melting point that is higher than a melting point of the magnetic materials of which the magnetic layers 11 are made. As a method of forming the stress relaxation layers, for example, a paste containing powder in which dissolution and sintering do not progress at the sintering temperature of the magnetic materials (powder having a melting point that is higher than a melting point of the magnetic materials, such as $ZrO_2$) is applied, or a sheet is disposed. It is to be noted that the first stress relaxation layers 41 and the second stress relaxation layers 42 only need to be made of a material that is less likely to allow propagation of stress therethrough than the magnetic layers even if stress is applied thereto.

Although the sectional shapes of the spiral layers 21 to 23 are substantially trapezoidal shapes, they may be substantially square shapes, substantially rectangular shapes, substantially semi-cylindrical shapes, or substantially hexagonal shapes. Although the first stress relaxation layers 41 are formed on two side surfaces of the spiral layers corresponding thereto, they may be formed at all outer peripheries of the sections of the spiral layers corresponding thereto. When the sectional shapes of the spiral layers are substantially rectangular shapes, substantially semi-cylindrical shapes, or substantially hexagonal shapes, they may be formed on only one side of the spiral layers corresponding thereto.

Figure 6:
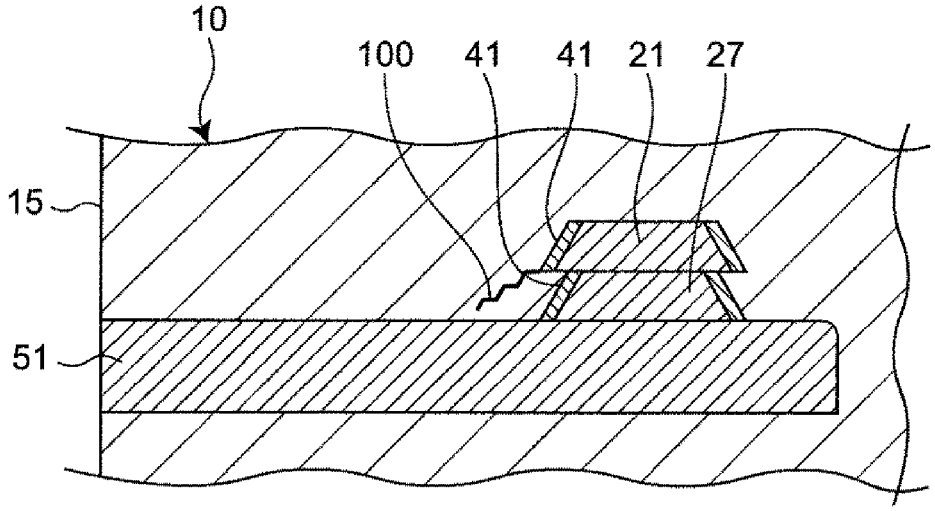
FIG. 6 is a sectional view of part of a coil component of a comparative example.

According to the coil component 1, since the second stress relaxation layers 42 each contact the coil-conductor-layer side (the side of the spiral layers 21 to 23) of the extended conductor layer 51 or 52, it is possible to reduce the stress between the extended conductor layers 51 and 52 and the corresponding coil conductor layers as a result of contact of the coil-conductor-layer side of each of the extended conductor layers 51 and 52 with the corresponding magnetic layers 11 being reduced. This makes it possible to reduce propagation of the stress of the element 10 to the first stress relaxation layers 41, and to reduce cracks that are produced in the element 10 from the first stress relaxation layers 41. In contrast, if, as shown in FIG. 6, the second stress relaxation layers are not provided, a crack 100 is produced from a side end of the first stress relaxation layer 41 that contacts the first spiral layer 21 towards the first extended conductor layer 51.

According to the coil component 1, each second stress relaxation layer 42 is positioned inside the side gap portion 10*a*, and does not reach the corresponding outer surface of the element 10. This makes it possible to reduce propagation of a plating solution or moisture along the second stress relaxation layers 42 and entry thereof into the element 10, and to prevent electrochemical migration of the spiral layers 21 to 23. As a result, it is possible to ensure insulation properties between the spiral layers 21 to 23 and to ensure reliability of the quality.

According to the coil component 1, since the first stress relaxation layers 41 contact the spiral layers 21 to 23 corresponding thereto and the connection layers 27 corresponding thereto, it is possible to reduce the stress of the element 10 and deterioration in the impedance and inductance characteristics.

Figure 4A:
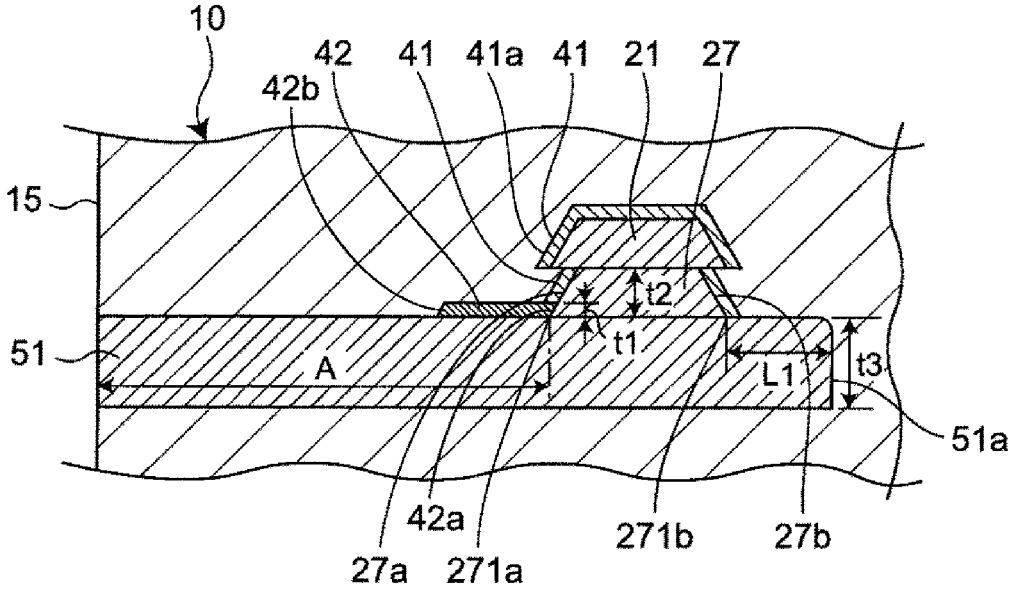
FIG. 4A is a sectional view of part of the coil component.
Figure 4B:
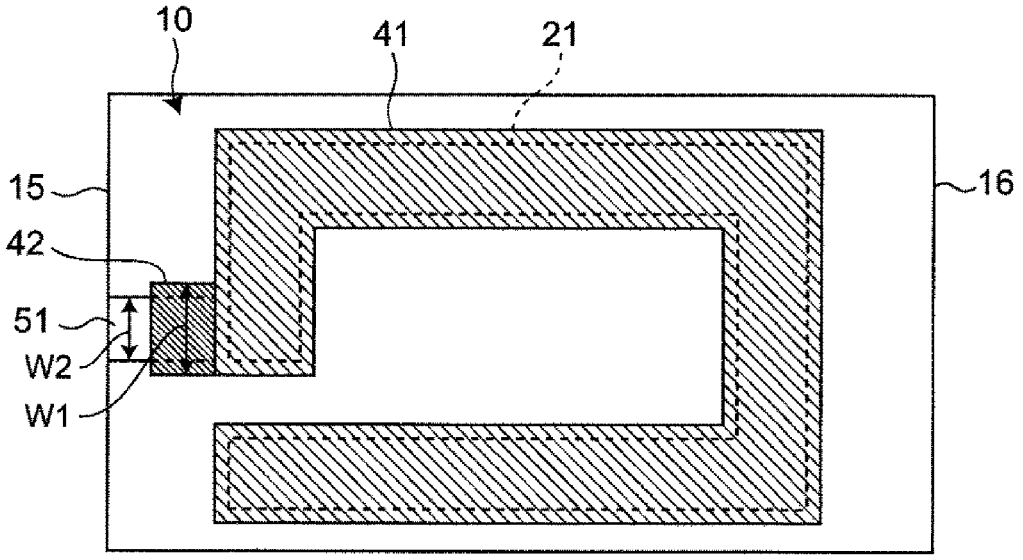
FIG. 4B is a plan view of part of the coil component.

FIG. 4A is a sectional view of part of the coil component 1. FIG. 4B is a plan view of part of the coil component 1. To facilitate understanding, FIG. 4B shows the first stress relaxation layers 41 and the second stress relaxation layer 42 by hatching.

Although FIGS. 4A and 4B show the structure of a first-extended-conductor-layer-51 side of the coil component 1, the structure of a second-extended-conductor-layer-52 side of the coil component 1 is similar. The structure of the first-extended-conductor-layer-51 side is described below. Since the structure of the second-extended-conductor-layer-52 side is similar, the description thereof is not given.

As shown in FIGS. 4A and 4B, the second stress relaxation layer 42 contacts the connection layer 27 as a first coil conductor layer that contacts the first extended conductor layer 51. The second stress relaxation layer 42 contacts a side surface of the connection layer 27. It is to be noted that this also similarly applies to the second stress relaxation layer 42 that contacts the second extended conductor layer 52.

A thickness t1 of a first end 42*a* of the second stress relaxation layer 42 that contacts the connection layer 27 (the first coil conductor layer) is desirably greater than or equal to about 1/10 of a thickness t2 of the connection layer 27, and less than or equal to the thickness t2 of the connection layer 27. Here, the thickness refers to the size in the first direction Z. The thickness t2 of the connection layer 27 as the first coil conductor layer is, for example, greater than or equal to about 20 μm and less than or equal to about 100 μm (i.e., from about 20 μm to about 100 μm). When the thickness t1 is greater than or equal to about 1/10 of the thickness t2 of the connection layer 27, it is possible to ensure the volume of the element 10 and maintain its characteristics while reliably reducing the stress of the element 10. When the thickness t1 is less than or equal to the thickness t2 of the connection layer 27, the volume of the element 10 is easily ensured, so that it is possible to suppress deterioration in the characteristics. It is to be noted that this also similarly applies to the second stress relaxation layer 42 that contacts the second extended conductor layer 52.

A width w1 of the second stress relaxation layer 42 is desirably greater than or equal to about ½ and less than or equal to about 3/2 (i.e., from about ½ to about 3/2) of a width w2 of the first extended conductor layer 51. Here, the width refers to the size in a direction orthogonal to a direction of extension of the second stress relaxation layer 42 as viewed from the first direction Z (planar direction). The width w2 of the first extended conductor layer 51 is, for example, greater than or equal to about 50 μm and less than or equal to about 400 μm (i.e., from about 50 μm to about 400 μm). Therefore, it is possible to ensure the volume of the element 10 and maintain its characteristics while reliably reducing the stress of the element 10. In contrast, when the width w1 of the second stress relaxation layer 42 is too small, the stress of the element 10 cannot be reduced. When the width w1 of the second stress relaxation layer 42 is too large, the volume of the element 10 is reduced and its characteristics are deteriorated. It is to be noted that this also similarly applies to the second stress relaxation layer 42 that contacts the second extended conductor layer 52.

The first spiral layer 21 as a second coil conductor layer contacts the connection layer 27 as the first coil conductor layer. The first end 42*a* of the second stress relaxation layer 42 in a length direction thereof contacts a first side end 27*a* of the connection layer 27. The length refers to the size in the direction of extension of the second stress relaxation layer 42. A second end 42*b* of the second stress relaxation layer 42 in the length direction thereof is situated at a position that is further from the first end 42*a* than a side end 41*a* of the first stress relaxation layer 41 that contacts the first spiral layer 21 in the length direction of the second stress relaxation layer 42. In the length direction of the second stress relaxation layer 42, the second end 42*b* of the second stress relaxation layer 42 is situated at a position that is closer to the first end 42*a* than a position at about ⅔ of a length A of the first extended conductor layer 51 from a first contact portion 271*a* of the connection layer 27 to the outer surface (the first end surface 15) of the element 10 with reference to the first contact portion 271*a* of the first side end 27*a* of the connection layer 27 that contacts the first extended conductor layer 51. The side end 41*a* of the first stress relaxation layer 41 and the first side end 27*a* of the connection layer 27 are situated at positions that are closest to the outer surface of the element 10 in the length direction of the second stress relaxation layer 42. It is to be noted that this also similarly applies to the second stress relaxation layer 42 that contacts the second extended conductor layer 52.

Therefore, since the second end 42*b* of the second stress relaxation layer 42 is situated at a position that is further than the side end 41*a* of the first stress relaxation layer 41 that contacts the first spiral layer 21, the second stress relaxation layer 42 makes it possible to reduce propagation of the stress of the element 10 to the first stress relaxation layer 41 and to reduce cracks that are produced in the element 10 from the first stress relaxation layer 41.

Since the second end 42*b* of the second stress relaxation layer 42 is situated at a position that is closer than the position at about ⅔ of the length A of the first extended conductor layer 51 from the first contact portion 271*a* of the connection layer 27 to the outer surface of the element 10 with reference to the first contact portion 271*a* of the connection layer 27, the second stress relaxation layer 42 does not reach the outer surface of the element 10. Therefore, it is possible to reduce propagation of a plating solution or moisture along the second stress relaxation layer 42 and entry thereof into the element 10, and to prevent electrochemical migration of the spiral layers 21 to 23 and the connection layers 27. As a result, it is possible to ensure insulation properties between the spiral layers 21 to 23 and the connection layers 27 to ensure reliability of the quality.

The thickness of a portion of the element 10 between the spiral layers 21 and 22 that are adjacent to each other in the first direction Z and the thickness of a portion of the element 10 between the spiral layers 22 and 23 that are adjacent to each other in the first direction Z are desirably less than or equal to about 40 μm. By this, although the portion between the spiral layers 21 and 22 that are adjacent to each other in the first direction Z and the portion between the spiral layers 22 and 23 that are adjacent to each other in the first direction Z are narrow and stress tends to be applied to the element 10, the second stress relaxation layer 42 makes it possible to reduce cracks that are produced in the element 10.

The thickness of the spiral layers 21 to 23 and the connection layers 27 are desirably greater than or equal to about 50 μm and less than or equal to about 200 μm (i.e., from about 50 μm to about 200 μm). By this, although the spiral layers 21 to 23 and the connection layers 27 are thick and stress tends to be applied to the element 10, the second stress relaxation layer 42 makes it possible to reduce cracks that are produced in the element 10.

At the connection layer 27 that connects the first extended conductor layer 51 and the first spiral layer 21, the connection layer 27 overlaps the first extended conductor layer 51 on an inner side in a direction of extension of the first extended conductor layer 51 (length direction) with respect to a side end 51*a* of the first extended conductor layer 51 in the direction of extension thereof. Specifically, a distance L1 in the direction of extension of the first extended conductor layer 51 from the side end 51*a* of the first extended conductor layer 51 to a second contact portion 271*b* of a second side end 27*b* that contacts the first extended conductor layer 51 is desirably greater than a thickness t3 of the first extended conductor layer 51 and less than twice the thickness t3 of the first extended conductor layer 51. The side end 51*a* of the first extended conductor layer 51 is a side end on an inner side of the element 10 in the direction of extension of the first extended conductor layer 51. The second side end 27*b* of the connection layer 27 is positioned on the side of the side end 51*a* of the first extended conductor layer 51. By this, it is possible to ensure connectivity of the connection layer 27 and the first extended conductor layer 51 regardless of the shape of the side end 51*a* of the first extended conductor layer 51. That is, in a printing method, the position where the connection layer 27 is provided is shifted inwardly of the side end 51*a* of the first extended conductor layer 51 to make it possible to prevent instability in the printing shape at the side end 51*a* of the first extended conductor layer 51, which is peculiar to the printing method, and to ensure stable connectivity. It is to be noted that this also similarly applies to the connection layer 27 that contacts the second extended conductor layer 52.

Similarly, at the connection layer 27 that connects the spiral layers 21 and 22 that are adjacent to each other in the first direction Z and at the connection layer 27 that connects the spiral layers 22 and 23 that are adjacent to each other in the first direction Z, each connection layer 27 overlaps the spiral layers on an inner side in a direction of extension of the spiral layers with respect to a side end of at least one of the spiral layers in a direction of extension of the at least one of the spiral layers. Specifically, a distance in the direction of extension of the spiral layer from the side end of the spiral layer to a contact portion of a side end of each connection layer 27 that contacts the spiral layer is desirably greater than the thickness of the spiral layer and less than twice the thickness of the spiral layer. By this, it is possible to ensure connectivity of the connection layers 27 and the spiral layers regardless of the shape of the side end of each spiral layer.

Second Embodiment

Figure 5:
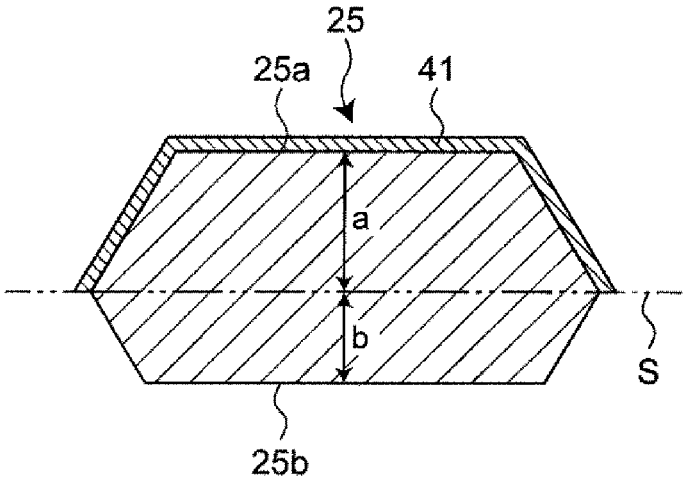
FIG. 5 is a sectional view of a coil conductor layer of a coil component according to a second embodiment of the present disclosure.

FIG. 5 is a sectional view of a coil conductor layer of a coil component according to a second embodiment of the present disclosure. As shown in FIG. 5, the sectional shape of a spiral layer 25 as a coil conductor layer is substantially hexagonal. A first stress relaxation layer 41 is formed along only three sides of the spiral layer 25. A thickness a of the spiral layer 25 on the side where the first stress relaxation layer 41 is formed is greater than a thickness b of the spiral layer 25 on the side where the first stress relaxation layer 41 is not formed.

Specifically, in a section in a direction orthogonal to the direction of extension of the spiral layer 25, a line that passes through the largest width of the spiral layer 25 is a reference line S. The reference line is orthogonal to the first direction Z. The thickness a from the reference line S to a first surface (upper surface) 25*a* of the spiral layer 25 on the side where the first stress relaxation layer 41 is formed is greater than the thickness b from the reference line S to a second surface (lower surface) 25*b* of the spiral layer 25 on the side where the first stress relaxation layer 41 is not formed. That is, a sectional area of the spiral layer 25 on the side of the first stress relaxation layer 41 with respect to the reference line S is greater than a sectional area of the spiral layer 25 on a side opposite to the first stress relaxation layer 41 with respect to the reference line S.

This makes it possible to increase the efficiency with which the characteristics resulting from stress release is acquired while ensuring the volume of the spiral layer 25. In contrast, when the thickness a of the spiral layer 25 on the side where the first stress relaxation layer 41 is formed is less than the thickness b of the spiral layer 25 on the side where the first stress relaxation layer 41 is not formed, the influence of stress is increased and the effect is reduced.

It is to be noted that, a first stress relaxation layer 41 may be provided only on the second surface (lower surface) 25*b* of the spiral layer 25. Here, a thickness a to the second surface 25*b* of the spiral layer 25 is greater than a thickness b to the first surface 25*a* of the spiral layer 25.

Third Embodiment

Figure 7:
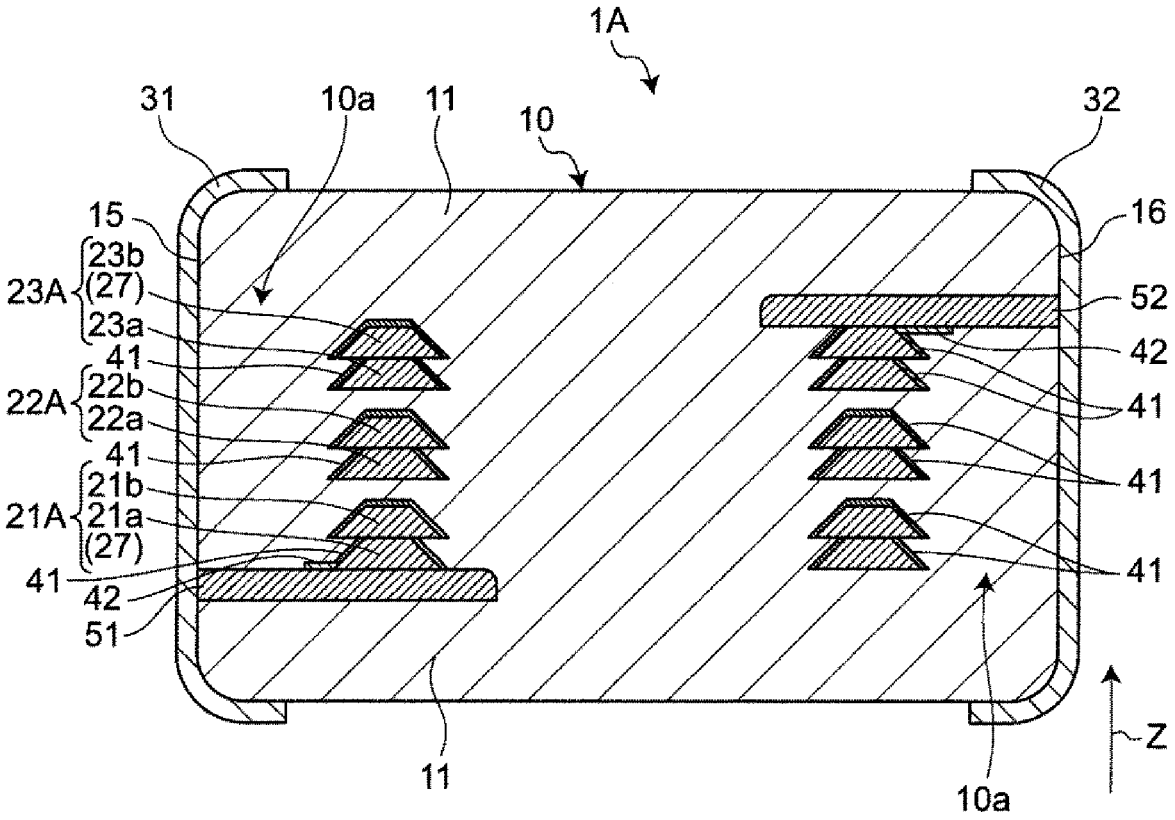
FIG. 7 is a sectional view of a coil component according to a third embodiment of the present disclosure.

FIG. 7 is a sectional view of a coil component 1A according to a third embodiment of the present disclosure. The third embodiment differs from the first embodiment in the number of layers that make up a spiral layer. This different structure is described below. The other structures are the same as those of the first embodiment, and are given the same reference numerals as those in the first embodiment and are not described.

As shown in FIG. 7, in the coil component 1A of the third embodiment, a first spiral layer 21A includes two layers, a first layer 21*a* and a second layer 21*b*, which are formed by, for example, two coatings. The first layer 21*a* and the second layer 21*b* have the same substantially spiral shape and are in surface-contact with each other. Similarly, a second spiral 22A includes a first layer 22*a* and a second layer 22*b*; and a third spiral layer 23A includes a first layer 23*a* and a second layer 23*b*. Therefore, it is possible to increase the sectional areas of the first spiral layer 21A to the third spiral layer 23A, and to reduce direct-current resistance. It is to be noted that the first spiral layer 21A to the third spiral layer 23A may include three or more layers. In the embodiment, the first layer 21*a* of the first spiral layer 21A and the second layer 23*b* of the third spiral layer 23A function as a connection layer 27.

It is to be noted that the present disclosure is not limited to the above-described embodiments, so that changes in design are possible within a scope that does not depart from the gist of the present disclosure. For example, the features of the first embodiment and the second embodiment may be variously combined.

Although, in the embodiments, the spiral layers are connected to the corresponding extended conductor layers via the connection layers, the spiral layers may directly contact the corresponding extended conductor layers without using the connection layers. Here, the first coil conductor layer that contacts the extended conductor layer is a spiral layer.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

an element; and a coil that is provided inside the element and that is spirally wound, wherein the coil includes a plurality of coil conductor layers and an extended conductor layer, which are laminated in a first direction, the extended conductor layer overlaps a side gap portion, which is situated on an outer side of a region of the element that is surrounded by the coil conductor layers, and extends so as to reach an outer surface of the element, and the element includes a first stress relaxation layer that contacts the coil conductor layers, and a second stress relaxation layer that, while extending along the extended conductor layer, contacts a coil-conductor-layer side of the extended conductor layer, and is positioned inside the side gap portion without reaching the outer surface of the element.

2. The coil component according to claim 1, wherein the plurality of coil conductor layers includes a first coil conductor layer that contacts the extended conductor layer, and the second stress relaxation layer contacts the first coil conductor layer.

3. The coil component according to claim 2, wherein a thickness of a portion of the second stress relaxation layer that contacts the first coil conductor layer is greater than or equal to about 1/10 of a thickness of the first coil conductor layer, and is less than or equal to the thickness of the first coil conductor layer.

4. The coil component according to claim 2, wherein a width of the second stress relaxation layer is from about 1/2 to about 3/2 of a width of the extended conductor layer.

5. The coil component according to claim 2, wherein the plurality of coil conductor layers includes a second coil conductor layer that contacts the first coil conductor layer, a first end of the second stress relaxation layer in a length direction thereof contacts a first side end of the first coil conductor layer, and in the length direction of the second stress relaxation layer, a second end of the second stress relaxation layer in the length direction thereof is situated at a position that is further from the first end than a side end of the first stress relaxation layer that contacts the second coil conductor layer, and is situated at a position that is closer to the first end than a position at about ⅔ of a length of the extended conductor layer from a first contact portion of the first coil conductor layer to the outer surface of the element with reference to the first contact portion of the first side end of the first coil conductor layer that contacts the extended conductor layer.

6. The coil component according to claim 1, wherein the plurality of coil conductor layers includes spiral layers that are each wound in a plane, and a thickness of a portion of the element between the spiral layers that are adjacent to each other in the first direction is less than or equal to about 40 μm.

7. The coil component according to claim 1, wherein a thickness of the coil conductor layers is greater than or equal to about 50 μm.

8. The coil component according to claim 1, wherein the first stress relaxation layer and the second stress relaxation layer are each a gap.

9. The coil component according to claim 1, wherein the first stress relaxation layer and the second stress relaxation layer are made of oxide powder having a melting point that is higher than that of a magnetic material of which the element is made.

10. The coil component according to claim 1, wherein the plurality of coil conductor layers includes a spiral layer that is wound in a plane and a connection layer that connects the spiral layer and the extended conductor layer to each other, the extended conductor layer includes a first end that is exposed from the element, and a second end on a side opposite to the first end, and the connection layer overlaps the extended conductor layer on an inner side in a length direction of the extended conductor layer with respect to the second end of the extended conductor layer.

11. The coil component according to claim 10, wherein, in the length direction of the extended conductor layer, a distance from the second end of the extended conductor layer to a contact portion of a side end of the connection layer that contacts the extended conductor layer is greater than a thickness of the extended conductor layer and is less than twice the thickness of the extended conductor layer.

12. The coil component according to claim 1, wherein the plurality of coil conductor layers includes spiral layers that are each wound in a plane and a connection layer that connects the spiral layers that are adjacent to each other in the first direction, and the connection layer overlaps the spiral layers on an inner side in a direction of extension of the spiral layers with respect to a side end of at least one of the spiral layers in a direction of extension of the at least one of the spiral layers.

13. The coil component according to claim 12, wherein, in the direction of extension of the spiral layer, a distance from the side end of the spiral layer to a contact portion of a side end of the connection layer that contacts the spiral layer is greater than a thickness of the spiral layer and is less than twice the thickness of the spiral layer.

14. The coil component according to claim 1, wherein a sectional shape of each coil conductor layer is substantially hexagonal, and the first stress relaxation layer is formed along only three sides of each coil conductor layer, and a thickness of each coil conductor layer on a side where the first stress relaxation layer is formed is greater than a thickness of each coil conductor layer on a side where the first stress relaxation layer is not formed.

15. The coil component according to claim 3, wherein a width of the second stress relaxation layer is from about ½ to about 3/2 of a width of the extended conductor layer.

16. The coil component according to claim 3, wherein the plurality of coil conductor layers includes a second coil conductor layer that contacts the first coil conductor layer, a first end of the second stress relaxation layer in a length direction thereof contacts a first side end of the first coil conductor layer, and in the length direction of the second stress relaxation layer, a second end of the second stress relaxation layer in the length direction thereof is situated at a position that is further from the first end than a side end of the first stress relaxation layer that contacts the second coil conductor layer, and is situated at a position that is closer to the first end than a position at about ⅔ of a length of the extended conductor layer from a first contact portion of the first coil conductor layer to the outer surface of the element with reference to the first contact portion of the first side end of the first coil conductor layer that contacts the extended conductor layer.

17. The coil component according to claim 2, wherein the plurality of coil conductor layers includes spiral layers that are each wound in a plane, and a thickness of a portion of the element between the spiral layers that are adjacent to each other in the first direction is less than or equal to about 40 μm.

18. The coil component according to claim 2, wherein a thickness of the coil conductor layers is greater than or equal to about 50 μm.

19. The coil component according to claim 2, wherein the first stress relaxation layer and the second stress relaxation layer are each a gap.

20. The coil component according to claim 2, wherein the first stress relaxation layer and the second stress relaxation layer are made of oxide powder having a melting point that is higher than that of a magnetic material of which the element is made.

* * * * *